US005482827A

United States Patent [19]

Besio et al.

[11] Patent Number: 5,482,827

[45] Date of Patent: Jan. 9, 1996

[54] HARDENED SILVER HALIDE PHOTOGRAPHIC ELEMENTS

[75] Inventors: Mauro Besio; Giuseppe Rocca, both of Vado Ligure, Italy

[73] Assignee: Minnesota Mining and Manufacturing Company, St. Paul, Minn.

[21] Appl. No.: 367,580

[22] Filed: Jan. 3, 1995

[30] Foreign Application Priority Data

Feb. 8, 1994 [EP] European Pat. Off. ..... 94101873

[51] Int. Cl.[6] ..... G03C 1/09; G03C 1/30

[52] U.S. Cl. ..... 430/603; 430/611; 430/623; 430/451

[58] Field of Search ..... 430/623, 603, 430/611, 451

[56] References Cited

U.S. PATENT DOCUMENTS 4,828,974 5/1989 Okamura et al. ..... 430/623

5,110,719 5/1992 Shuto et al. ..... 430/611

5,292,635 3/1994 Lok ..... 430/603

OTHER PUBLICATIONS

Research Disclosure 17643, Dec. 1978.

*Primary Examiner*—Richard L. Schilling
*Assistant Examiner*—Mark F. Huff
*Attorney, Agent, or Firm*—Gary L. Griswold; Walter N. Kirn; Mark A. Litman

[57] ABSTRACT

Light-sensitive silver halide photographic elements comprising a support bearing at least one gelatin-containing silver halide emulsion layer, wherein the silver halide emulsion is chemically sensitized with sulfur and gold in the presence of a sulfinic acid compound and the gelatin is hardened with a carbamoylpyridinium salt compound.

10 Claims, No Drawings

HARDENED SILVER HALIDE PHOTOGRAPHIC ELEMENTS

FIELD OF THE INVENTION

The present invention relates to hardened silver halide photographic elements, and in particular to silver halide photographic elements chemically sensitized with sulfur and gold in the presence of a sulfinic acid compound.

BACKGROUND OF THE INVENTION

Silver halide photographic elements comprise at least one hydrophilic colloid as a binder. In most silver halide photographic elements, gelatin is used as hydrophilic colloid. For example, gelatin is used as the main binder in silver halide emulsion layers, protective layers, filter layers, intermediate layers, antihalation layers, backing layers, subbing layers and so on. Usually, such gelatin layers are treated in photographic uses with aqueous solutions having different pH's and temperatures. Gelatin layers, however, have a poor resistance to water and swell excessively, so that they have a greatly reduced mechanical strength and are easily scratched. In extreme cases, especially at high temperature, the gelatin layers dissolve in aqueous solutions.

A number of classes of compounds are known for increasing water resistance, heat resistance and abrasion resistance of gelatin layers. These compounds are known as hardeners in the photographic art. These include, for example, inorganic compounds such as chromium, aluminum and zirconium salts; aldehydes and halogenated aldehyde compounds such as formaldehyde, glutaraldehyde and muchochloric acid; bisvinylsulfone compounds; bisepoxides; bisacrylamides; halogenated triazines; dioxanes and the like.

In the choice of a hardener, the hardener should meet at least the following conditions.

(1) It should be photochemically inert. In other words, it should not afford chemically adverse effects (e.g., decrease in sensitivity, fading of the latent image, and fogging) on the performance of the silver halide photographic emulsion layer.
(2) It should be chemically stable in solid or solution state.
(3) It should have a sufficient solubility in water so that hardening is liable to be even within the layer.
(4) It should be not harmful to the human body.
(5) It should not react with other photographic additives except the gelatin.
(6) It should have an hardening effect which attains its maximum as soon as possible after drying, so that the degree of hardening will not change for a long period of time due to "post-hardening" and the material which is being hardened will not continuously change its permeability to developer solutions.

A problem has been observed by the Applicant in the hardening of photographic elements in which silver halide emulsions are chemically sensitized with sulfur and gold in the presence of sulfinic acid compounds as antifogging agents. Hardening agents such as halotriazine compounds used in combination with the lo above photographic elements show a high hardening reaction for gelatin and a small post-hardening effect. The main disadvantage with these hardeners is the liberation of hydrogen halides during hardening and consequently fading of the latent image. It is well known that images with the silver halide photographic process are obtained by image exposure for forming latent images and development for converting the latent images into silver images. Latent image fading caused by the halotriazine hardeners has the consequence of lowering the sensitivity of the silver halide photographic element, possibly to unacceptable values. Hardening agents such as vinylsulfone type hardeners used in combination with the above photographic elements have generally a high hardening rate and a small post-hardening effect. The main disadvantage with these hardeners is that they react with sulfinic acid compounds used as antifoggant agents in sulfur and gold sensitized silver halide emulsions. This reaction reduces the hardening power of the vinylsulfone type hardeners and the antifogging property of the sulfinic acid compounds. Additionally, the reaction of the hardener and the sulfinic acid compound produces water-insoluble compounds which can cause defects in the photographic element. The same reaction with sulfinic acid compounds is obtained with other hardeners such as formamidinium type hardeners described in U.S. Pat. No. 4,418,142.

These materials are not capable of satisfactorily hardening a silver halide photographic material in which a silver halide emulsion has been chemically sensitized with sulfur and gold in the presence of a sulfinic acid compound. It is, therefore, an object of the present invention to provide a gelatin-containing silver halide photographic element sulfur and gold sensitized in the presence of a sulfinic acid compound, in which gelatin is efficiently and quickly hardened and no latent image fading occurs.

It has now been discovered that gelatin-containing silver halide photographic elements sulfur and gold sensitized in the presence of sulfinic acid compounds can be hardened without the disadvantages of most previously known hardeners by using a carbamoylpyridinium salt.

Carbamoylpyridinium salt hardeners are known. Details concerning the preparation and properties thereof may be found in U.S. Pat. Nos. 3,880,665, 4,014,862 and 4,063,952. These patents, however, do not suggest the use of said hardeners in gelatin-containing silver halide photographic elements chemically sensitized with sulfur and gold in the presence of sulfinic acid compounds. The fact that the carbamoylpyridinium salt hardeners do not react with sulfinic acid compounds is not reported in the literature and is very surprising.

SUMMARY OF THE INVENTION

In accordance with the present invention there is provided a light-sensitive silver halide photographic element comprising a support bearing at least one gelatin-containing silver halide emulsion layer. The element according to the present invention is characterized in that the silver halide emulsion is chemically sensitized with sulfur and gold in the presence of a sulfinic acid compound and the gelatin is hardened with a carbamoylpyridinium salt compound.

DETAILED DESCRIPTION OF THE INVENTION

The silver halide emulsion for use in the present invention, after silver halide grain formation and desalting, is chemically sensitized by at least one gold sensitizer and at least one sulfur sensitizer.

Gold sensitization is performed by adding a gold sensitizer to the silver halide emulsion and stirring the emulsion at high temperature of preferably 40° C. or more for a predetermined period of time. As a gold sensitizer, any gold compound which has an oxidation number of +1 or ∓and is normally used as gold sensitizer can be used. Preferred examples of gold sensitizers are chloroauric acid, the salts thereof and gold complexes, such as those described in U.S. Pat. No. 2,399,083. It is also useful to increase the gold sensitization by using a thiocyanate together with the gold sensitizer, as described, for example, in T. H. James, *The Theory of the Photographic Process,* 4th edition, page 155, published by Macmillan Co., 1977. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole metho-chloride and ammonium aurothiocyanate.

Sulfur sensitization of the silver halide emulsion employs sulfur-containing compounds, e.g., allylisothiocyanate, sodium thiosulfate and allyl thiourea. Particularly preferred sulfur sensitization in the present invention employs thiosulfonate sensitizers. Thiosulfonate sensitization is performed by adding a thiosulfonate sensitizer to the silver halide emulsion and stirring the emulsion at high temperature of 40° C. or more for a predetermined period of time. Thiosulfonate sensitizers in the present invention can be represented by the following general formula $R—SO_2—S—M$ wherein R represents an aliphatic group, an aromatic group or a heterocyclic group and M represents a cation.

The aliphatic group represented by R can be a saturated or unsaturated, straight-chain, branched or cyclic aliphatic hydrocarbon group and is preferably an alkyl group of 1 to 22 carbon atoms (such as methyl, ethyl, propyl, butyl, pentyl, hexyl, 2-ethylhexyl, decyl, dodecyl, octadecyl, cyclohexyl and t-butyl), an alkenyl group of 2 to 22 carbon atoms (such as allyl and butenyl), or an alkynyl group of 2 to 22 carbon atoms (such as propargyl and butynyl).

The aromatic group represented by R includes single-ring or condensed-ring aromatic groups arid has preferably 6 to 20 carbon atoms (such as phenyl, tolyl and naphthyl).

The heterocyclic group represented by R includes a 5- or 6-membered heterocyclic group having one or more heteroatoms (such as nitrogen, oxygen, sulfur, selenium and tellurium). Examples of suitable heterocyclic groups are pyrrolyl, furanyl, piperidino, morpholino, pyridino, picolino, pyrrolidino, thiophene, oxazole, benzoxazole, tetrazole, thiazole, benzothiazole and thiadiazole. The aliphatic, aromatic and heterocyclic groups represented by R can have substituents.

M is preferably a metal ion or an organic cation. Examples of metal ions are $Li^+$, $Na^+$ and $K^+$. Examples of organic cations are an ammonium ion (such as ammonium, tetramethylammonium and tetrabutylammonium), a phosphonium ion (such as tetraphenylphosphonium) and a guanidyl group.

In the most preferred embodiment, R is a tolyl group and M is $Na^+$ or $K^+$.

When the term "group" is used in this invention to describe a chemical compound or substituent, the described chemical material includes the basic group and that group with conventional substitution. When the term "moiety" is used to describe a chemical compound or substituent, only an unsubstituted chemical material is intended to be included. For example, "alkyl group" includes not only such alkyl moieties as methyl, ethyl, octyl, tearyl, etc., but also such moieties bearing substituents groups such as halogen, cyano, hydroxy, nitro, amino, carboxylate, etc. On the other hand, "alkyl moiety" includes only methyl, ethyl, octyl, stearyl, cyclohexyl, etc.

The addition amounts of the gold sensitizer and the sulfur sensitizer for use in the present invention change in accordance with the various conditions, such as activity of the gold and sulfur sensitizer, type and size of tabular silver halide grains, temperature, pH and time of chemical ripening. Said amounts, however, are preferably $1\times10^{-4}$ to $1\times10^{-7}$ mol of gold sensitizer per mol of silver, and $1\times10^{-4}$ to $1\times10^{-6}$ mol of sulfur sensitizer per mol of silver halide. The temperature of chemical ripening is preferably 45° C. or more, and more preferably 50° C. to 80° C. The pAg and pH may take arbitrary values.

During chemical ripening, addition times and order of gold sensitizer and sulfur sensitizer are not particularly limited. For example, gold and sulfur sensitizers can be added at the initial stage of chemical ripening or during chemical ripening either simultaneously or at different timings. Usually, gold and sulfur sensitizers are added to the tabular silver halide emulsion by their solutions in water, in a water-miscible organic solvent, such as methanol, ethanol and acetone, or a mixture thereof.

According to the present invention, a sulfinic acid compound is added to the silver halide emulsion during chemical ripening with a gold and a sulfur sensitizer in an amount of $1\times10^{-1}$ to $1\times10^{-4}$ per mol of silver halide. More preferably, the silver halide emulsion is subjected to chemical ripening with a gold sensitizer and a sulfur sensitizer in the presence of a sulfinic acid compound added during chemical ripening in an amount of $5\times10^{-1}$ to $1\times10^{-3}$ mol per mol of silver halide. The sulfinic acid compound added during chemical ripening of the silver halide emulsion by gold and sulfur sensitizers is capable of controlling fogging by retarding the ripening process and gives a better fog/sensitivity ratio.

The sulfinic acid compound for use in the present invention can be represented by the formula $R—SO_2—M$ wherein R and M have the same meanings as defined for thiosulfonate sensitizers. In a preferred embodiment, R is a tolyl group and M is a metal ion or an organic cation. In a more preferred embodiment, sulfinic acid compounds are $Na^+$ or $K^+$ salts of p-toluene sulfinate.

Thiosulfonate and sulfinate compounds can be prepared with methods known in the art as described, for example, in *Journal of Organic Chemistry*, vol. 53, p. 386 (1988) and *Chemical Abstracts,* vol. 59, 9777e. The more preferred compounds, sodium or potassium p-toluene thiosulfonate and p-toluene sulfinate, are available on the market of chemical compounds.

The hardeners used according to the present invention in silver halide photographic elements chemically sensitized with sulfur and gold in the presence of a sulfinic acid compound are carbamoylpyridinium compounds. Preferably said carbamoylpyridinium compounds correspond to the following general formula:

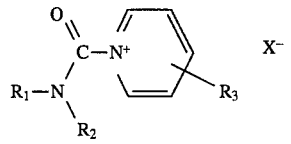

wherein $R_1$ and $R_2$, which may be the same or different, each represents an alkyl group having from 1 to 10 carbon atoms (e.g., methyl, ethyl, 2-ethylhexyl, etc.), an aryl group having from 6 to 15 carbon atoms (e.g., phenyl, naphthyl, etc.), or an aralkyl group having from 7 to 15 carbon atoms(e.g., benzyl, phenethyl, etc.), or $R_1$ and $R_2$, together with the nitrogen atom, constitute the atoms required to form a heterocyclic ring (e.g., piperidine, morpholine, piperazine, pyrrolidine, etc.), $R_3$ represents a substituent such as a hydrogen atom, an alkyl group having from 1 to 10 carbon atoms, an alkoxy group having from 1 to 10 carbon atoms, a halogen atom, a sulfo group, a ureido group, a carbamoyl group, etc., and $X^-$ represents an anion, such as a halide ion, a sulfate ion, a sulfonate ion, $ClO_4^-$, $BF_4^-$, $PF_6^-$, $NO_3^-$, etc. When $R_3$ is an alkoxy group or an alkyl group, these groups may be substituted by a substituent such as a halogen atom, a carbamoyl group, or a ureido group. When a sulfo group is present in the formula above, the sulfo group may form an intramolecular salt with the positively charged nitrogen atom and said X-is not necessary.

Carbamoylpyridinium salt compounds have a high water solubility, a fast hardening action for gelatin and lower occurrence of post-hardening. Their water solutions must, however, be added to the silver halide emulsion within 1–10 hours after being made. Otherwise, the solution degrades rapidly and loses its hardening power. It has been found that the water solution of carbamoylpyridinium salt compounds can be increased from a few hours to 10 days or more by selecting compounds of formula

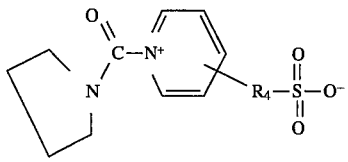

wherein $R_4$ represents an alkylene group of 1 to 4 carbon atoms, such as methylene, ethylene, propylene or a single chemical bond. The increased stability of the solution is highly beneficial in the manufacturing system of silver halide photographic elements since most solutions that are designed to be added to a silver halide emulsion are usually prepared well in advance of their addition date.

Practical examples of carbamoylpyridinium compounds for use in this invention are illustrated below, but the invention is not limited to these compounds.

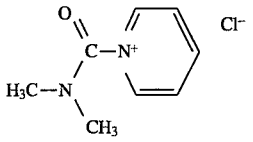

H-1

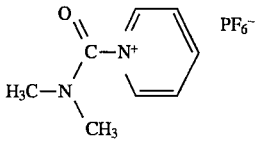

H-2

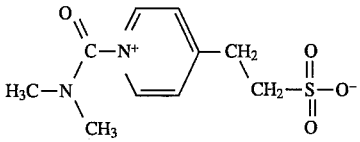

H-3

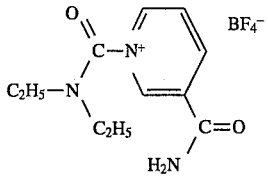

H-4

-continued

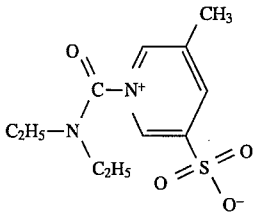

H-5

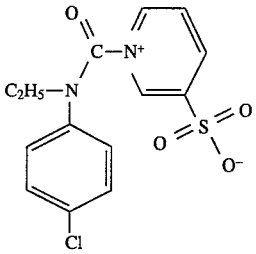

H-6

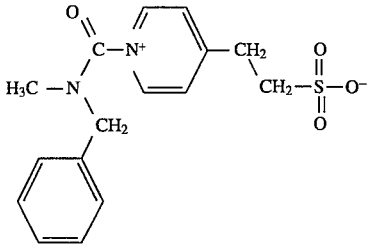

H-7

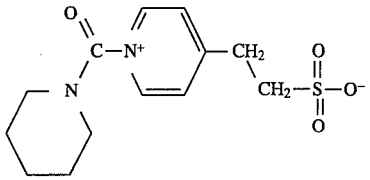

H-8

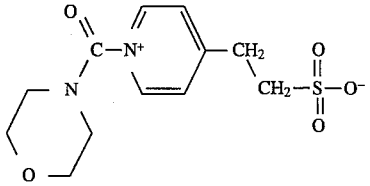

H-9

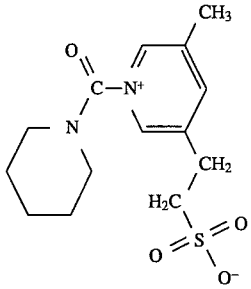

H-10

-continued

H-11

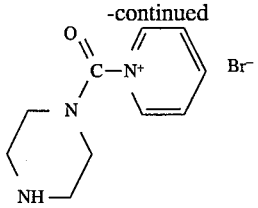

H-12

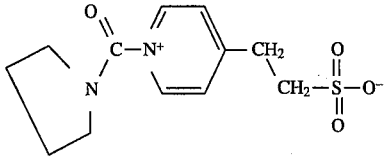

H-13

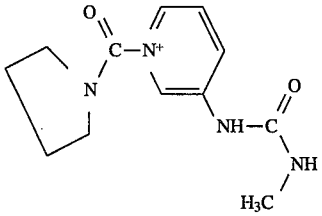

H-14

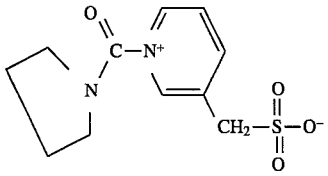

H-15

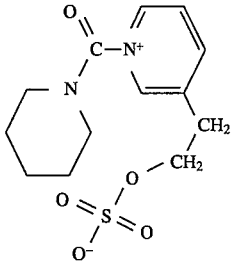

H-16

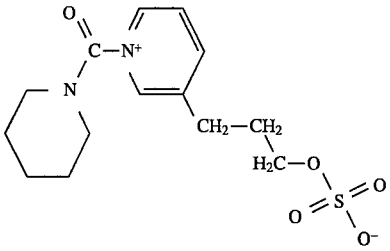

H-17

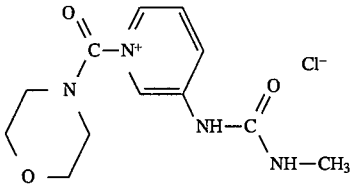

-continued

H-18

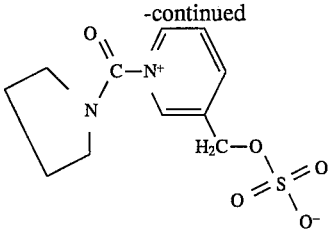

H-19

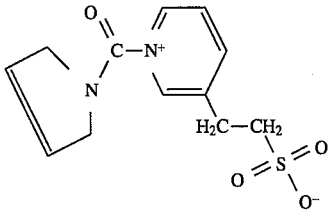

When the hardening agents represented by the aforesaid formula are used for photographic layers of silver halide photographic materials chemically sensitized with sulfur and gold in the presence of sulfinic acid compounds, undesirable phenomena such as latent image instability and reaction of the hardener with the sulfinic acid compounds are reduced. Also, hardening proceeds very quickly and reaches the final hardened degree in only a few days after coating and post-hardening is not substantially observed.

The amount of the hardening agent in the present invention is not particularly limited, but can be selected freely depending on the intended purpose. The amount used generally ranges from 0.1 to 20%, preferably 0.2 to 10%, by weight with respect to the weight of the dry gelatin in the photographic element.

The carbamoylpyridinium salt compounds can be used singly or as a mixture thereof. Also, they can be used together with conventionally known hardening agents, as those aforesaid described. The hardening agents in the present invention can be incorporated in gelatin layers of the photographic elements in various ways, for example, by adding the hardening agents to a gelatin composition before coating or by dipping a dried gelatin layer into a hardener solution. It is preferred to add the hardening agents shortly before coating because they react very rapidly with gelatin.

The silver halide emulsion of the present invention can be used for every photographic element, such as color photographic elements (for example, color photographic negative films, color photographic reversal films, color photographic positive films, color photographic papers and reversal papers), black and white photographic elements (for example, black and white photographic films, radiographic photographic films, lithographic films, black and white photographic papers, and micrographic films), etc.

Preferred silver halide photographic elements are multilayer color photographic elements comprising a blue sensitive silver halide emulsion layer associated with yellow dye-forming color couplers, a green sensitive silver halide emulsion layer associated with magenta dye-forming color couplers and a red sensitive silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

When using multilayer color photographic elements, it is contemplated in the present invention to have blue sensitive silver halide emulsion layers comprising a carbamoylpyridinium salt compound as hardening agent for the gelatin in said layers, and green sensitive and red sensitive silver halide emulsion layers comprising a different hardening agent having a fast hardening action for the gelatin of said layers, a low post-hardening effect and no reaction with sulfinic acid compounds, such as a halotriazine compound, for example, 2,4-dicloro-6-hydroxy-s-triazine or 2-chloro-4,6-dihydroxy-s-triazine sodium salt. It has been found that the fading of latent image in a multilayer color photographic element is a problem mainly related to the blue sensitive silver halide emulsion layers. The latent image in a silver halide emulsion consists of minute specks of metallic silver formed in the interior or on the surface of individual silver halide grains upon exposure to actinic radiation. Development of exposed silver halide elements will selectively reduce to metallic silver those silver halide grains containing a latent image speck above a threshold size. It is known that a latent image is not permanent and, over a period of time, it fades with a consequent loss in image density and speed. By hardening the gelatin of the blue sensitive silver halide emulsion layer with a carbamoylpyridinium salt compound, the stability of the latent image of the multilayer color photographic element results substantially increased, even if the gelatin of the other layers is hardened with a different hardening agent.

In said multilayer color photographic elements, suitable color couplers are preferably selected from the couplers having diffusion preventing groups; such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

In order to disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 μm. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

Examples of magenta couplers which can be used in the present invention can be selected from those described in U.S. Pat. Nos. 2,600,788; 3,558,319; 3,468,666; 3,419,301; 3,.253,924 and 3,311,476 and in British patents 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications 1,956,281, 2,162,899 and 2,213,461 and in British Patents 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British patent 1,464,361.

Colorless couplers which can be used in the present invention can be selected from those described in British patents 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications Ser. No. 2,414,006; 2,659,417; 2,527,652; 2,703,145 and 2,626,315; in Japanese patent applications S.N. 30,591/75 and 82,423/77 and in British patent 1,153,587.

Examples of non-color forming DIR coupling compounds which can be used in the present invention include those described in U.S. Pat. Nos. 3,938,996; 3,632,345; 3,639,417; 3.297,445 and 3,928,041; in German patent applications S.N. 2,405,442; 2,523,705; 2,460,202; 2,529,350 and 2,448,063; in Japanese patent applications S.N. 143,538/75 and 147,716/75 and in British patents 1,423,588 and 1,542,705.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed as a partial replacement of conventional gelatin (alkali-treated, acid-treated or enzyme-treated gelatin), e.g.; a gelatin derivative such as acylated gelatin, graft gelatin, etc., albumin, gum arabic, agar agar, a cellulose derivative, such as hydroxyethyl-cellulose, carboxymethyl-cellulose, etc., a synthetic resin, such as polyvinyl alcohol, polyvinylpyrrolidone, polyacrylamide, etc. Preferred silver halides are silver iodobromide or silver iodo-bromo-chloride containing 1 to 12% mole silver iodide. The silver halide grains may have any crystal form such as cubical, octahedral, tabular or a mixed crystal form. The silver halide can have a uniform grain size or a broad grain size distribution. The size of the silver halide ranges from about 0.1 to about 5 μm. The silver halide emulsion can be prepared using a single-jet method, a double-jet method, or a combination of these methods or can be matured using, for instance, an ammonia method, a neutralization method, an acid method, etc. The emulsions which can be used in the present invention can be optically sensitized as described in Research Disclosure 17643, IV, December 1978; they can contain optical brighteners, antifogging agents and stabilizers, filtering and antihalo dyes, coating aids, plasticizers and lubricants and other auxiliary substances, as for instance described in Research Disclosure 17643, V, VI, VIII, X, XI and XII, December 1978. The layers of the photographic emulsion and the layers of the photographic material can contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVIII, December 1978. The light-sensitive silver halide contained in the photographic materials of the present invention after exposure can be processed to form a visible image by associating the silver halide with an aqueous alkaline medium in the presence of a developing agent contained in the medium or in the material. Processing formulations and techniques are described in Research Disclosure 17643, XIX, XX and XXI, December 1978.

The following examples are described for a better understanding of this invention.

EXAMPLE 1

An aqueous 12% gelatin solution was divided into six portions and each portion was added with the compounds reported in Table 1. Each portion was coated on a cellulose triacetate support at a dry thickness of about 1 μm and dried to provide each of the gelatin layers (A) to (F). Each sample was placed under conditions of 25° C. and 50% relative humidity, and after 1 day, 1 week or 1 month since the coating each sample was measured with respect to the hardness as follows. The hardness was measured with a particular instrument provided with a stylus which engraves the sample imbibed with a liquid composition, water or processing solution, where it has been kept for a given temperature. The hardness values are expressed in grams loaded on the stylus to engrave the sample: the higher the weight, the harder the material. The results thus obtained are shown in Table 1 below.

TABLE 1

| Sample | Hardener and mM/100 g gel. | Antifoggant and mM/100 g gel. | Hardness 1 d. | 1 w. | 1 m. |
|---|---|---|---|---|---|
| A | Compound I 4.8 | — | 105 | 175 | 210 |
| B | Compound I 4.8 | Compound IV 8.4 | 105 | 165 | 195 |
| C | Compound II 4.8 | — | 90 | 175 | 250 |
| D | Compound II 4.8 | Compound IV 8.4 | 45 | 45 | 60 |
| E | Compound III 19.2 | — | 175 | 175 | 175 |
| F | Compound III 19.2 | Compound IV 8.4 | 90 | 90 | 90 |

Other samples (G) to (N) were obtained following a procedure similar to that described above. The following Table 2 shows the compounds used in each sample and the results thus obtained.

TABLE 2

| Sample | Hardener and mM/100 g gel. | Antifoggant and mM/100 g gel. | Hardness 1 d. | 1 w. | 1 m. |
|---|---|---|---|---|---|
| G | Compound I 4.8 | — | 125 | 260 | 300 |
| H | Compound I 4.8 | Compound IV 3.0 | 90 | 175 | 250 |
| I | Compound II 4.8 | — | 232 | 325 | 383 |
| L | Compound II 4.8 | Compound IV 3.0 | 118 | 225 | 230 |
| M | Compound H-3 19.2 | — | 280 | 264 | 286 |
| N | Compound H-3 19.2 | Compound IV 3.0 | 315 | 275 | 360 |

Compound I (described in U.S. Pat. No. 3,325,287):

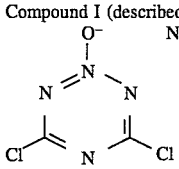

Compound II (described in U.S. Pat. No. 4,173,481):

$CH_2=CH-SO_2-CH_2-CH(OH)-CH_2-SO_2-CH-CH_2$

Compound III (described in U.S. Pat. No. 4,673,481):

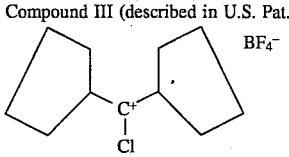

Compound IV:

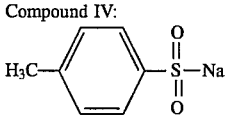

Compound H-3 (described in the present invention):

As is apparent from the results in Tables 1 and 2, a gelatin layer containing a carbamoylpyridinium salt as hardener reaches its maximum hardening degree in a short time without changing it during the time and its hardness is not affected, according to this invention, by the presence of a sulfinic acid compound.

EXAMPLE 2

A first photographic film (Film 1) was prepared by coating on a subbed cellulose triacetate support a silver bromoiodide emulsion containing 12.0 mol % of silver iodide and having an average diameter of 1.1 μm at a silver coating weight of 1.3 g/m$^2$ and gelatin coverage of 1.4 g/m$^2$. The emulsion, before coating, had been chemically digested with 2.8 μmoles/mol Ag of $AuCl_3$, 310 μmoles/mol Ag of KCNS and 217 μmoles/mol Ag of sodium p-toluenethiosulfonate, optically sensitized with a benzothiazolocyanine dye, stabilized with a 4-hydroxy-2,5-di-methyl-1,4,7a-triazaindene and added with an oil dispersion of a 2-equivalent pyvaloylacetanilide yellow dye forming coupler. The sample was hardened by addition to the emulsion, before coating, of comparison Compound I of Example 1 used in amount of 6 mmoles per 100 g of gelatin.

A second photographic film (Film 2) was prepared which was identical to Film 1 except that the hardener used was Compound H-3 according to the present invention used in amount of 12.5 mmoles per 100 g of gelatin.

The amount of hardener in each film was such to give a hardness (measured as described in Example 1) of about 180.

Two samples (Sample 1 and 2) of each film were exposed at 5000 K through a continuous wedge of 0.30 gradient. Other two samples (Sample 3 and 4) of each film were not exposed. Samples 1 and 3 were stored for 7 days at room conditions, while samples 2 and 4 were stored for 7 days at 38° C. and 75% relative humidity. After storage, samples 3 and 4 were exposed as said before, then all the samples (1, 2, 3 and 4 of each film, all exposed) were processed in a C-41 process as described in British journal of Photography, July 1974, pages 597–598. The relative speed of each sample was measured at 0.20 above fog and the latent image stability was measured as speed variation between samples 3 and 1, and samples 4 and 2 of each film. The results obtained are shown in Table 3 below.

TABLE 3

| | Speed variation (log E) | |
|---|---|---|
| Film | Sample 3-Sample 1 | Sample 4-Sample 2 |
| 1 (comp.) | −0.20 | −0.16 |
| 2 (inv.) | −0.05 | +0.03 |

It can be understood from these results that, in the photographic film hardened according to the present invention, latent image fading is substantially inhibited even in the presence; of a sulfinic acid compound.

EXAMPLE 3

4% aqueous solutions of carbamoylpyridinium hardeners reported in Table 4 were prepared using deuterated water as solvent. The solutions were kept at room temperature and the percentage of decomposed hardener was determined by using NMR analysis. Table 4 reports percentage of hardener decomposition during the time of storage.

TABLE 4

| | % decomposition | | |
|---|---|---|---|
| Hardener | 24 hours | 7 days | 10 days |
| H-9 | 37.0 | 75.0 | — |
| H-8 | 10.0 | 23.7 | 32.3 |
| H-19 | 1.0 | 7.5 | 12.5 |
| H-12 | 0.0 | 0.0 | >1.0 |

TABLE 4-continued

| | % decomposition | | |
|---|---|---|---|
| Hardener | 24 hours | 7 days | 10 days |
| H-3 | 0.0 | 3.0 | 30.0 |

As is apparent from the results of Table 4, carbamoylpyridinium hardener derived from pyrrolidine has increased water stability compared to other carbamoylpyridinium hardeners.

EXAMPLE 4

An aqueous 17.1% gelatin solution was divided into four portions and each portion was added with the compounds reported in Table 5. Each portion was coated on a cellulose triacetate support at a dry thickness of about 12 grams of gelatin per square meter and dried to provide each of the gelatin layers (A) to (D). Each sample was stored at room temperature and, after 7 days since the coating, each sample was measured with respect to the hardness as reported in Example 1. The results thus obtained are shown in Table 5 below.

TABLE 5

| Sample | Hardener and mMoles | Antifoggant and mMoles | Hardness 7 days |
|---|---|---|---|
| A | Compound H-3 3.56 | — — | 443 |
| B | Compound H-3 3.56 | Compound IV 0.6 | 435 |
| C | Compound H-12 3.56 | — — | 465 |
| D | Compound H-12 3.56 | Compound IV 0.6 | 570 |

Compound IV:

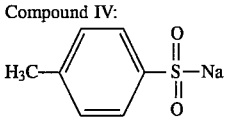

Compound H-3 (described in the present invention):

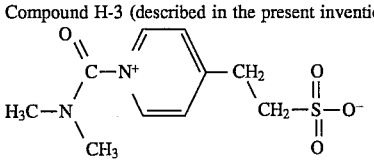

Compound H-12 (described in the present invention):

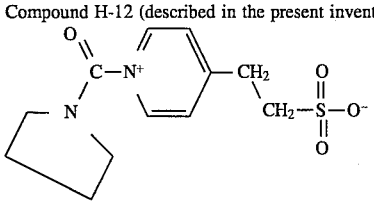

As is apparent from the results in Table 5, a gelatin layer containing a carbamoylpyridinium salt as hardener has its hardness little affected by the presence in the layer of a sulfinic acid compound.

We claim:

1. A negative-acting light-sensitive silver halide photographic element comprising a support beating at least one light-sensitive gelatin-containing silver bromide or iodobromide emulsion layer and at least one non light-sensitive gelatin-containing layer, wherein the silver bromide or iodobromide- emulsion is chemically sensitized with sulfur and gold in the presence of a sulfinic acid compound and all gelatin present in said photographic element is hardened with a carbamoylpyridinium salt compound having the following formula:

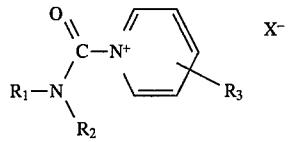

wherein $R_1$ and $R_2$, which may be the same or different, each represents an alkyl group, an aryl group, or an aralkyl groups, or $R_1$ and $R_2$ together represent the atoms required to complete a heterocyclic ring, $R_3$ represents an alkylsulfonate group or a sulfonate group, and $X^-$ represents an anion.

2. The photographic element of claim 1, wherein said silver bromide or iodobromide emulsion layer is a blue-sensitive silver bromide or iodobromide emulsion layer associated with a yellow dye-forming coupler.

3. The photographic element of claim 2, further comprising at least one gelatin-containing green-sensitive silver bromide or iodobromide emulsion layer associated with a gelatin-containing magenta dye-forming coupler and at least one red-sensitive silver bromide or iodobromide emulsion layer associated with a cyan dye-forming coupler.

4. The photographic element of claim 3, wherein said green-sensitive and/or red-sensitive emulsion layers are chemically sensitized with sulfur and gold in the presence, of a sulfinic acid compound and all the gelatin present in said photographic element is hardened with a carbamoylpyridinium salt compound.

5. The photographic element of claim 1, wherein the silver bromide or iodobromide emulsion is chemically sensitized with a gold compound selected in the group consisting of chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

6. The photographic element of claim 1, wherein the silver bromide or iodobromide emulsion is chemically sensitized with a sulfur compound represented by the following general formula R—SO2—S—M wherein R represents an aliphatic group, an aromatic group or a heterocyclic group and M represents a cation.

7. The photographic element of claim 1, wherein the silver bromide or iodobromide emulsion is chemically sensitized with a sulfur and gold in the presence of a sulfinic acid compound represented by the formula R—SO2—M wherein R represents an aliphatic group, an aromatic group or a heterocyclic group and M represents a cation.

8. The photographic element of claim 1, wherein the carbamoylpyridinium salt compound corresponds to the following general formula:

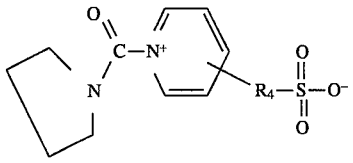

wherein $R_4$ represents an alkylene group of 1 to 4 carbon atoms or a single chemical bond.

9. The photographic element of claim 1, wherein the carbamoylpyridinium salt compound corresponds to the formula:

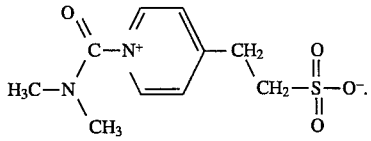

10. The photographic element of claim 1, wherein the carbamoylpyridinium salt compound corresponds to the formula:

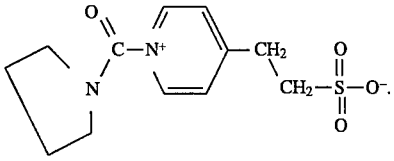

* * * * *

UNITED STATES PATENT AND TRADEMARK OFFICE

CERTIFICATE OF CORRECTION

PATENT NO.: 5,482,827

DATED: January 9, 1996

INVENTOR(S): Besio et al.

It is certified that error appears in the above-identified patent and that said Letters Patent is hereby corrected as shown below:

Column 1, line 59, delete the word "lo".
Column 2, line 65, delete "+1 or ‡", and insert --+1 or +3--.
Column 11, line 32, delete "XVIII", and insert --XVII--.
Column 12, line 57, after "Compound H-3 (described in the present invention):"
Insert the chemical structure:

--

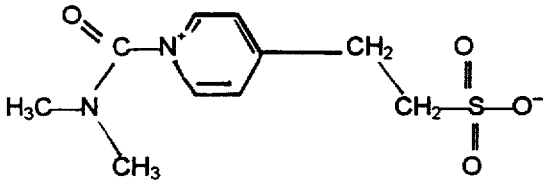

--.

Column 14, line 65, delete "beating" and insert --bearing--.

UNITED STATES PATENT AND TRADEMARK OFFICE

CERTIFICATE OF CORRECTION

PATENT NO.: 5,482,827

DATED: January 9, 1996

INVENTOR(S): Besio et al.

It is certified that error appears in the above-identified patent and that said Letters Patent is hereby corrected as shown below:

On the first page, at [75] Inventors:, after "Mauro Besio; Giuseppe Rocca, both of Vado Ligure, Italy", add the following:
--Mario Mariotti of Carcare, Italy and Giuseppe Bussi of Saliceto, all of Italy--.

Signed and Sealed this

Ninth Day of July, 1996

*Attest:*

Bruce Lehman

BRUCE LEHMAN

*Attesting Officer*

*Commissioner of Patents and Trademarks*